United States Patent [19]

Wood

[11] 4,402,775

[45] Sep. 6, 1983

[54] HYBRID GUN PROPELLANT

[75] Inventor: Stanley E. Wood, Inyokern, Calif.

[73] Assignee: The United States of America as represented by the Secretary of the Navy, Washington, D.C.

[21] Appl. No.: 391,268

[22] Filed: Jun. 24, 1982

[51] Int. Cl.[3] ..... C06B 31/52

[52] U.S. Cl. ..... 149/49; 149/46; 149/74; 149/96; 149/100

[58] Field of Search ..... 149/100, 46, 49, 74, 149/96

[56] References Cited

U.S. PATENT DOCUMENTS 3,234,729 2/1966 Altman et al. ..... 149/74

3,962,001 6/1976 Marhofer et al. ..... 149/74

*Primary Examiner*—Stephen J. Lechert, Jr.

*Attorney, Agent, or Firm*—R. F. Beers; W. T. Skeer; B. H. Cottrell

[57] ABSTRACT

A hybrid gun propellant containing an oxidizer rich liquid monopropellant and an oxidizer deficient single based solid propellant.

8 Claims, 1 Drawing Figure

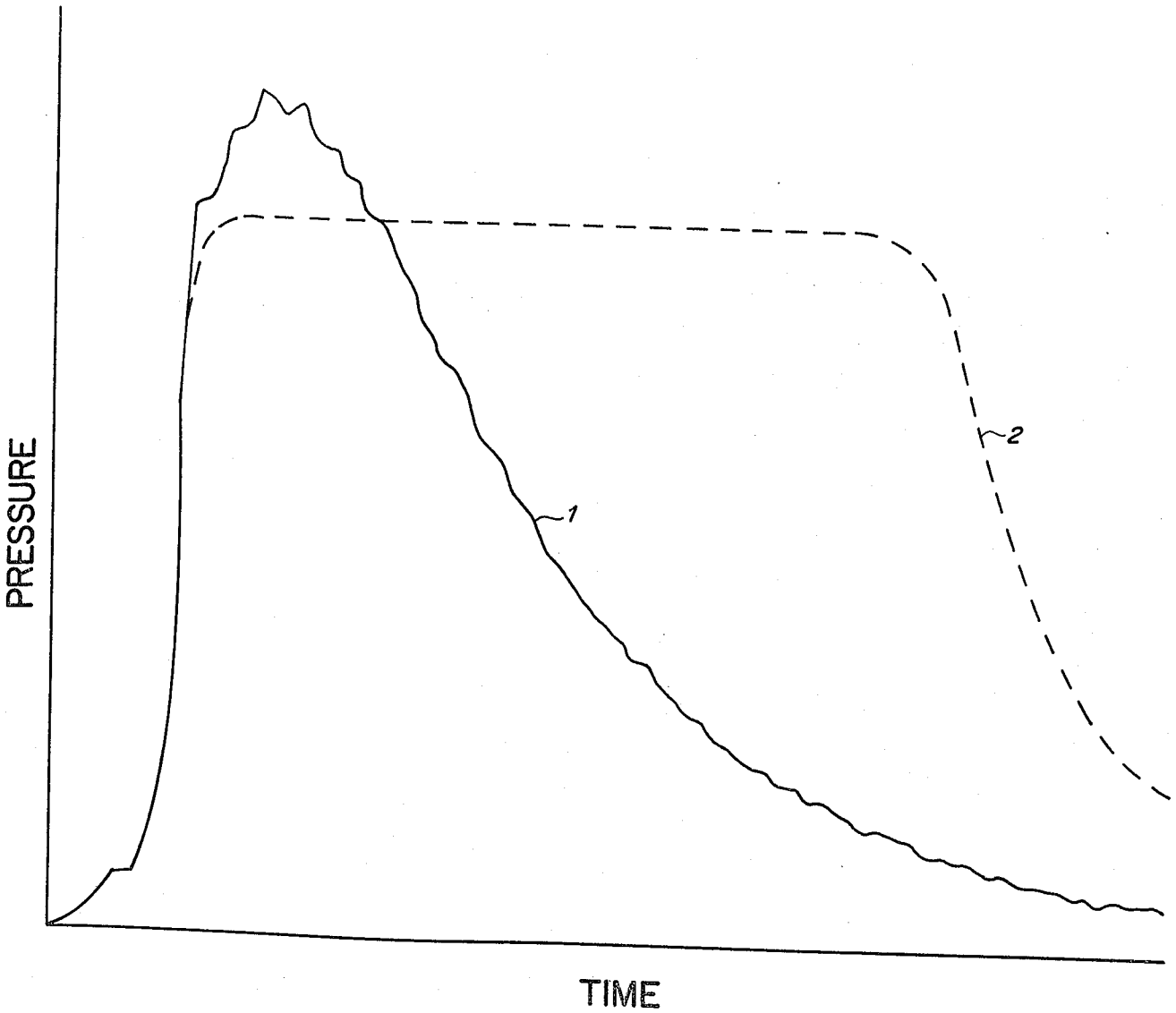
PRESSURE
TIME
1
2

HYBRID GUN PROPELLANT

BACKGROUND OF THE INVENTION

1. Field of the Invention

This invention relates to propellants. Particularly, this invention relates to gun propellants. More particularly, this invention relates to hybrid gun propellants. In still greater particularity, this invention relates to hybrid gun propellants containing a liquid oxidizer rich monopropellant and an oxygen deficient solid propellant.

2. Description of the Prior Art

Conventional gun propellants have been from two classes either solid or liquid. Solid propellants are characteristically fuel rich which can result in muzzle flash from unburned fuel when a projectile exits from a gun muzzle. Excessive muzzle flash is undesirable for military guns as it can permit an enemy to locate and identify ground based gun systems.

Liquid monopropellants are characterized by difficulties in the control of their pressure/time history. Hydroxylammonium nitrate (HAN) has previously been used in conjunction with other ingredients in liquid monopropellant guns. There were problems controlling the pressure/time history which resulted in unacceptable shot to shot variations. Later, HAN was studied as an oxidizer with hydrocarbon (HC) fuels in liquid bipropellant systems. Although there were good combustion results, the volume ratio of oxidizer to fuel needed to be large. A by volume ratio exceeding 10 parts HAN to 1 part HC restricted this system.

The pressure/time history or curve produced by conventional solid propellants contains a high pressure peak. This high pressure placed stress upon the gun and caused flame erosion in the gun barrels. Additionally, the sharp peak results in acceleration loads on the projectile, which places stress on any mechanism in the projectile, i.e. fuze and guidance systems.

Additionally, the muzzle velocity is determined by the area under the pressure versus time curve. An increase in muzzle velocity over conventional gun propellant systems could be achieved by altering the pressure/time curve.

Often, it can be desirable to fire a heavier projectile. In order to fire a substantially heavier than normal projectile from a given size cartridge, other parameters must be adjusted. With a solid propellant, a heavier projectile required the use of a different propellant to moderate the peak pressure. Otherwise, the result would be a large increase in peak pressure or a much reduced muzzle velocity.

SUMMARY OF THE INVENTION

This invention provides a propellant with a greater muzzle velocity with a lower peak pressure than the prior art. This new hybrid gun propellant contains an oxidizer rich liquid and an oxidizer deficient single based solid propellant. The pressure versus time curve of the hybrid gun propellant has a reduced pressure peak, but has a large pressure plateau which yields a greater muzzle velocity by providing a greater area under the pressure/time curve.

OBJECTS OF THE INVENTION

In view of the foregoing, it is an object of this invention to provide a hybrid gun propellant utilizing both a solid and liquid propellant.

Another object of this invention is to provide a gun propellant which produces a greater muzzle velocity with a lower peak pressure.

A further object of this invention is to provide a gun propellant which reduces muzzle flash.

Yet another object of this invention is to provide a gun propellant which places reduced acceleration loads on the projectiles.

Still another object of this invention is to provide for a lower peak pressure in the gun barrel to produce less flame erosion and reduced stress on the gun barrel.

A still further object of the invention is to provide a gun propellant which can fire a heavier than normal projectile for a given cartridge size without a significant decrease in muzzle velocity or an increase in peak pressure of the gun.

These and other objects of the invention will become more readily apparent from the following specification when taken together with the drawings.

BRIEF DESCRIPTION OF THE DRAWING

The FIGURE shows a pressure versus time profile for a conventional propellant and the hybrid propellant.

DESCRIPTION OF THE PREFERRED EMBODIMENT

A pressure versus time curve or trace can be determined for every gun and propellant system. The conventional pressure versus time curve with a standard solid propellant is shown in the FIGURE at 1. By the addition of an oxidizer rich liquid during the combustion cycle a plateau or flattened curve can be obtained as seen at 2.

By using a combination of an oxidizer rich liquid monopropellant with a conventional oxidizer deficient solid gun propellant, the overall oxygen balance of the propellant system can be improved yielding a more complete burn or combustion. This combination of a liquid and a solid propellant gives rise to the hybrid gun propellant term. The hybrid gun propellant has given an improved performance. This improvement results from increased piezometric efficiency or the flattening of the pressure/time curve.

A gun having a reduced peak pressure suffers less flame erosion in the gun barrel and has less stress on the gun. The hybrid propellant system has the reduced peak pressure, but has given over a 200 ft/sec increase in muzzle velocity. This result occurs from the longer plateau shape of the pressure/time curve. The longer a pressure can be maintained as a projectile travels down the barrel, the greater the exit velocity will be. The hybrid system results in a slower acceleration of the projectile through the barrel, but by maintaining the pressure longer gives the increased muzzle velocity.

The hybrid gun system can work when any oxidizer rich liquid is utilized to balance the oxygen of an oxygen deficient solid propellant. Single based solid propellants or powders are typically more oxygen deficient than double based propellants. Single based means there is no nitroglycerin which would raise the oxygen balance and make a propellant more oxidizer rich. Preferable solid propellants would be nitrocellulose based (single based) propellants. Examples that have worked particularly well include Improved Military Rifle (IMR) powders 5010, 4831 and 4350. One specific liquid used was hydroxylammonium nitrate (HAN) and water. HAN is an oxidizer rich monopropellant.

The HAN and water admixture is a low viscosity, clear liquid in which the water is not strictly speaking the solvent. There is insufficient water present to solvate all the ions from the ionization of HAN.

The HAN/water liquid has been used with single based solid propellants. Test firings using this hybrid propellant in a 30-mm gun are shown in Table 1. A standard or conventional firing of standard Aden propellant is also given for comparison. Standard Aden is a standard solid propellant of the British used in a 30-mm gun.

TABLE 1

| Firing Number | 1 | 2 | 3 | 4 | ADEN |
|---|---|---|---|---|---|
| Projectile wt (grams) | 224.6 | 223.0 | 222.2 | 303.0 | 221.0 |
| Solid Charge (grams) | 44.7 (IMR 4350) | 36.2 (IMR 4350) | 45.4 (IMR 4831) | 45.4 (IMR 4831) | 45.4 Std. Aden |
| Liquid Charge 13M HAN (grams) | 20.7 | 29.3 | 31.5 | 22.5 | — |
| Muzzle Velocity (ft/sec) | 2811 | 2755 | 2838 | 2468 | 2567 |
| Peak Pressure (KPSI) | 47 | 39 | 37 | 44 | 46 |
| Muzzle Pressure (KPSI) | 4 | 3 | 5 | 3 | 2 |

Other oxidizer rich liquids can be used in the hybrid gun propellants. A HAN, ammonium nitrate and water system or nitric acid could be used to supply the extra oxygen to the solid propellants.

Table 2 contains the test results from several 20 mm gun firings. With IMR 4831 as the solid propellant, firings 1 and 2 used the HAN and water mixture and firings 3 and 4 used the HAN, ammonium nitrate (AN) and water mixture. Firing 5 used WC 870, a standard 20 mm powder (Olin-Matheson ball powder). The HAN-/AN/water mixture was 6.5 M HAN and 5.5 M AN.

The HAN/AN/water admixture showed a dramatic decrease in the peak pressure so can be seen by comparing firing 3 to both firing 2 and 5. The IMR 4831 powder is a faster burning powder than a typical 20-mm gun powder. This resulted in the higher peak pressure of firing 2 when the oxidizer rich liquid was HAN and water. While both the HAN/water mixture and the HAN/AN/water mixture gave increased muzzle velocity over the solid propellant alone, the HAN/AN/water mixture had the lowest peak pressure in the 20-mm firing.

TABLE 2

| Firing Number | 1 | 2 | 3 | 4 | 5 |
|---|---|---|---|---|---|
| Projectile wt (grams) | 98.2 | 99 | 99.2 | 98.8 | 98–99 |
| Solid Charge (grams) | 25.5 (IMR 4831) | 30 (IMR 4831) | 34.5 (IMR 4831) | 25.5 (IMR 4831) | 38.5 (WC 870) |
| Liquid Charge (grams) | 28.0 13M HAN | 23.5 13 M HAN | 23.0 HAN/AN | 32 HAN/AN | — |
| Muzzle Velocity (ft/sec) | 3860 | 4240 | 3688 | 2429 | 3380 ± 50 |
| Peak Pressure (KPSI) | 75 | 90 | 40 | 18 | 55 |
| Muzzle Pressure (KPSI) | 7 | 6 | 8 | — | 3–4 |

Obviously many modifications and variations of the present invention are possible in light of the above teachings. It is therefore understood that within the scope of the appended claims, the invention may be practiced otherwise than as specifically described.

What is claimed is:

1. A gun propellant composition comprising:

an oxidizer rich liquid selected from the group consisting of a hydroxylammonium nitrate and water admixture and a hydroxylammonium nitrate, ammonium nitrate and water admixture; and an oxidizer deficient single based solid propellant.

2. A gun propellant composition according to claim 1 wherein said oxidizer rich liquid is a hydroxylammonium nitrate and water admixture.

3. A gun propellant composition according to claim 1 wherein said oxidizer rich liquid is a hydroxylammonium nitrate, ammonium nitrate and water admixture.

4. A gun propellant according to claim 1 or 3 wherein said hydroxylammonium nitrate, ammonium nitrate and water admixture is 6.5 molar hydroxylammonium nitrate and 5.5 molar ammonium nitrate.

5. A gun propellant composition according to claim 1 wherein said oxidizer rich liquid is 30–55% by weight of 13 molar hydroxylammonium nitrate.

6. A gun propellant composition according to claim 1 or 2 wherein said hydroxylammonium nitrate and water admixture is 13 molar hydroxylammonium nitrate.

7. A gun propellant according to claim 4 wherein said hydroxylammonium nitrate, ammonium nitrate and water admixture as the oxidizer rich liquid is 30–55% by weight of said composition.

8. A gun propellant according to claim 6 wherein said hydroxylammonium nitrate and water admixture as the oxidizer rich liquid is 30–55% by weight of said composition.

* * * * *